US008915665B2

(12) United States Patent
Gozlan

(10) Patent No.: US 8,915,665 B2
(45) Date of Patent: Dec. 23, 2014

(54) WRITING UTENSIL

(75) Inventor: Eliahou Gozlan, Haifa (IL)

(73) Assignees: Eliahou Gozlan, Haifa (IL); Gabriel Megara, Nahariya (IL)

( * ) Notice: Subject to any disclaimer, the term of this patent is extended or adjusted under 35 U.S.C. 154(b) by 408 days.

(21) Appl. No.: 13/314,900

(22) Filed: Dec. 8, 2011

(65) Prior Publication Data

US 2012/0148333 A1 Jun. 14, 2012

(30) Foreign Application Priority Data

Dec. 8, 2010 (IL) ..... 209843

(51) Int. Cl.
*B43K 1/02* (2006.01)
*B43K 5/18* (2006.01)

(52) U.S. Cl.
CPC .... *B43K 1/02* (2013.01); *B43K 5/18* (2013.01)
USPC ..... 401/222; 401/232; 401/241

(58) Field of Classification Search
CPC ..... B43K 1/02
USPC ..... 401/221, 232, 236, 237, 241
See application file for complete search history.

(56) References Cited

U.S. PATENT DOCUMENTS

| | | | | | |
|---|---|---|---|---|---|
| 779,692 | A | * | 1/1905 | Crowell | 401/154 |
| 1,007,619 | A | * | 10/1911 | Vogelmann | 401/158 |
| 1,415,718 | A | * | 5/1922 | Sharah Y Cantos | 401/45 |
| 2,093,545 | A | | 9/1937 | Wares et al. | |
| 2,289,998 | A | * | 7/1942 | Salz | 401/224 |
| 4,474,487 | A | * | 10/1984 | Malamoud | 401/231 |
| 5,015,113 | A | * | 5/1991 | Yamanaka | 401/224 |
| 5,980,765 | A | | 11/1999 | Machida et al. | |
| 6,250,832 | B1 | * | 6/2001 | Del Vecchio | 401/151 |
| 2008/0181715 | A1 | | 7/2008 | Cohen | |

* cited by examiner

*Primary Examiner* — David Walczak
*Assistant Examiner* — Joshua Wiljanen
(74) *Attorney, Agent, or Firm* — Browdy and Neimark, PLLC

(57) ABSTRACT

An improved nib for writing with ink on media that comprises a tube having a proximal opening, a slanted distal opening, an interior wall and an exterior wall, an exposed writing tip at a distal end of the nib, wherein the tip has a groove extending from the tip along at least a portion of the interior wall, and a slit extending from the tip along a part of the nib, wherein the tip is made of a ceramic material.

17 Claims, 6 Drawing Sheets

WRITING UTENSIL

FIELD OF THE INVENTION

The present invention is in the field of writing utensils, in particular of utensils for specialized writing.

BACKGROUND OF THE INVENTION

Applying ink by using a writing utensil hails back to the times Pharaohs, when scribes wrote on papyrus scrolls using reeds. In general, writing ends of nibs in pens (hereinbelow referred to as tips) may be for example round, stub, italic, calligraphic, and/or oblique. The exact shape affects the shape and thickness of the written characters, which also depend on how the pen is held, such as what the orientation of the tip length and width is relative to the media, in which hand the pen is held etc (see http://www.pentrace.net/article052501085.html).

U.S. Pat. No. 293,545 to Waterman describes a fountain pen having the following components: a slit nib; a barrel, which holds an ink reservoir, and a cap, which fits over the nib of the pen to protect it from damage. The slit at the tip controls the flow of ink. The pen operates by air inducing flow of ink from the barrel to the nib tip, and capillary action along the slit at the tip inducing flow of ink along the nib, to provide a steady and even flow of ink from the fountain pen.

Another type of sophisticated writing tool is a calligraphic pen. Today calligraphy is performed using special writing utensils in which the tip may be flat rather than slanted typical in fountain pens. The flat end allows for applying strokes of adjustable width according to the rotation of a handheld barrel during the process of writing. Although ballpoint pens have replaced the fountain pen as the universal writing tool, fountain and calligraphic pens continue to be popular with collectors as well as those who desire a more elegant and sophisticated writing tool.

For example, calligraphic style of writing and tips are used for example in writing Jewish scrolls.

Writing on Jewish scrolls must be manually performed on leather parchment using special black ink. Very high demands are made of the ink. It must be coal black, without even a slightest tint, highly viscous to prevent it from soaking and spreading on the scroll and to allow it to emboss the characters and symbols, and durable and resilient in the face of centuries of existence. The ink is usually made of: coal, gals (small epiphyllous balls on oak leaves), wood rosin, and blue vitriol. This mixture makes the ink ineffaceable.

The special characteristics of the ink as well as other special religious requirements, pose rigorous requirements on the writing technique, as well as on the suitable utensil. The tip of a quill is traditionally used for writing scripture on parchment. The bottom part is specially prepared using a knife or other sharp edged instrument, by cutting and suitably configuring the tip.

The viscosity of the special ink requires pressing of the tip to the scroll to allow expansion of the slit of the tip and thus flow of the ink. However, the rough hide of the scroll quickly wears out soft quill tips, consequently requiring frequent and lengthy sharpening of the quill, and it is difficult to reproduce the tip in a desired profile.

Other feasible writing utensils may be prepared from reeds or thermoplastic imitation quills. The flexible tips allow easy expansion of the slit for broad strokes and application of light thin strokes by minimal expansion of the slit; however, rigid nibs have several important advantages as they tend to produce a cleaner, more defined writing line, and their ink flow is likely to be more consistent.

Indeed, the first fountain pen nibs were made of gold alloys, often dipped in a hard metal called iridium for strength and resistance to corrosion and wear. However, when gold alloy nibs became too expensive to mass-produce, steel was adopted as the material of choice.

IL patent 131687 describes a specially configured and dimensioned nib, for traditionally writing Jewish scripture on parchment. The nib is described as made of material selected from the group consisting of a metal, a metal alloy, and a plastic.

Despite the advantages related above, metal nibs are religiously problematic for writing in Jewish scriptures. Moreover, the special ink tends to corrode the metal (to counter precipitation in the ink, the ink is typically made more acidic with vinegar or even hydrochloric or sulfuric acid, which tend to cause galvanic corrosion of the nib, particularly in the slit). Furthermore, the rough scroll erodes even metal nibs as well, so that periodic grinding of the nibs is required. Even nibs of pens such as fountain pens, used for writing on plain smooth paper, may require periodic grinding maintenance. Although the grinding of a metal nib is obviously required less frequently than the sharpening of a quill tip, proper and satisfactory grinding of the metal nibs can be very difficult to master (http://www.marcuslink.com/pens/aboutpens/ludwig-tan.html).

Another problem with quills is that they require frequent dipping in an inkwell. Pens suitably configured for writing Jewish scriptures, equipped with an ink reservoir such as in modern pens, would save this effort. However, leaks of ink from various pens with ink reservoirs can be a significant problem. Such leaks may be caused by excessive pressure on the nibs or tips, which may cause excessive widening of the slit, or changes in the viscosity of the ink from body (hand) warmth and/or changes in the room temperature. Such leaks might disqualify a piece of scroll which has been toiled over for many hours.

U.S. 2008181715 describes a fountain pen for traditional writing Jewish of scripture on parchment, that includes a configured nib, an ink loader for feeding ink to said nib, a reservoir for storing said ink, a piston for creating a customable pressure inside said reservoir, and a hollow barrel having an open front and rear ends for housing said piston, ink loader, nib and reservoir.

U.S. Pat. No. 5,980,765 describes a composite ceramics material suited for balls of ball-point pens, and a method of manufacturing composite ceramics balls for ball-point pens, that have affinity for both oil-based ink and water-based ink. The composite ceramics, whose main components are mullite and zirconia ($ZrO_2$) at the ratio of 50-95% to 5-50% by weight, is polished into mirror-finished balls and then chemical processing or physical processing is performed on the ball surfaces to form indentations in the ball surfaces.

Despite the many developments of writing utensils, there is an unmet need for simple fountain/calligraphic pens that write flawlessly, have a pleasant writing feel, and transform one's handwriting for the better—a pen that is an extension of the hand, rather than an impediment to it. ]

There is a need for pens that allow easy control and adjustment of the flow of ink; there is also need of pens that require minimal upkeep.

Another aim is to improve calligraphic writing efficiency.

BRIEF DESCRIPTION OF THE FIGURES

In order to better understand the present invention and appreciate its practical applications, the following Figures are attached and referenced herein. Like components are denoted by like reference numerals.

It should be noted that the figures are given as examples and preferred embodiments only and in no way limit the scope of the present invention as defined in the appended Description and Claims.

SUMMARY OF INVENTION

Figure 1A:
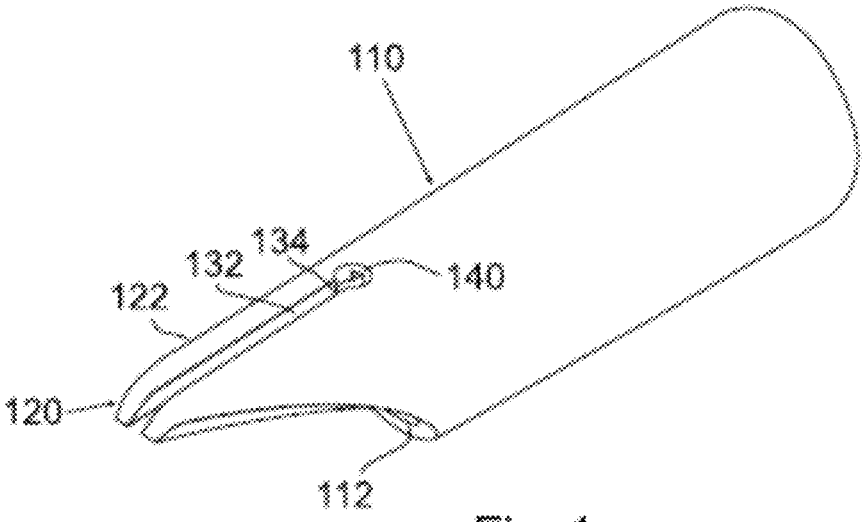
FIG. 1*a* illustrates a side view of an improved nib embodiment for writing with ink on media.

According to one aspect, an improved nib for writing with ink on media is provided, the nib comprising:

i. a tube comprising a proximal opening, a slanted distal opening, an interior wall and an exterior wall;

ii. an exposed writing tip at a distal end of the nib, wherein the tip comprises a width, iii. a groove extending from the tip along at least a portion of the interior wall, and iv. a slit extending from the tip along a part of the nib, wherein the tip is made of a material comprising ceramic material.

In some embodiments, the nib is made of ceramic material, such as one or more of the group comprising: alumina, zirconia, carbide, mullite, corierite, nitride and combinations thereof.

In some embodiments, the ceramic material comprises ceramic fibres and/or ceramic whiskers.

In some preferred embodiments, the groove comprises a slit extending from the tip along a part of the nib.

Preferably, the nib further comprises at least one breather hole at a proximal end of the slit.

In preferred embodiments, the nib is configured to allow steady flow of the ink to the writing tip.

In some embodiments, the nib is further configured to prevent blotting of the ink on the media.

In some embodiments, the ink is Jewish scripture ink and the media is a Jewish scroll.

In embodiments where the media is a Jewish scroll, the nib width is preferably configured to suit the size of the Jewish scroll.

In embodiments where the media is a Jewish scroll, the width is preferably between about 0.5 and 3 mm.

In some embodiments, the tip is chiseled.

According to another aspect of the invention, a writing utensil comprising one of the nibs described above is provided, wherein the writing utensil is selected from: a fountain pen, a calligraphic pen and a quill.

The nibs may be round, stub, italic, calligraphic, or oblique.

The groove may be tapered toward the tip.

The groove is preferably configured to allow uniform flow.

According to another aspect, a method of manufacturing an improved nib is provided, the method comprising:

injection molding followed by sintering, or slip casting, or pressing an improved nib for writing with ink on media, the nib comprising: a tube comprising a proximal opening, a slanted distal opening, an interior wall and an exterior wall, and an exposed writing tip at a distal end of the distal opening, wherein the tip comprises a width, and, the tip is made of a material comprising ceramic material, and making a groove in the nib, the groove extending from the tip along at least a portion of the interior wall.

In some nib manufacturing methods the groove comprises a slit extending from the tip along the interior wall.

In some the groove extends all along the interior wall.

The slit may be made during the injection molding.

Alternatively, the slit may be made by a cutting disk.

Some embodiments further comprise making a profile for the improved nib tip, comprising frictionally moving the nib tip relative to a metal bond diamond polishing means.

The profile making may further comprise machining the nib tip, whereby the profile of the nib tip is sharp.

According to another aspect, an improved pen for writing with ink on media is provided, the pen comprising:

a hollow barrel having proximal and distal openings;

a cap on the proximal opening of the barrel;

a needle attached to the cap and distally extending from the cap throughout the barrel, the needle comprising a distal part having a tapering shape;

a nib comprising: a tube comprising a proximal opening, a slanted distal opening, an interior wall and an exterior wall; an exposed writing tip at a distal end of the distal opening, a slit extending from the tip along a part of the nib, and a groove extending proximally from the tip along at least a portion of the interior wall, and;

a nib ink feeder comprising: a proximal part having a proximal feeder opening; a distal part having a distal feeder opening; an exterior wall and a first and a second hole; the distal part of the feeder being positioned within the nib and the proximal part of the feeder sealing the distal opening of the barrel; the wall of the feeder at the distal part of the feeder being flush with the interior wall of the nib; the first hole extending from the proximal feeder opening through part of the feeder to a tapered part, the tapered part being similar in profile to the distal end of the needle, the second hole extending from the tapered part of the first hole distal feeder opening and fluidly communicable with the groove, the needle being reversibly extendible within the feeder, the pen configured to allow continuous flow of the ink during writing with the pen and control of the flow rate of the ink.

In some embodiments the cap further comprises at least one filling hole extending through the cap, the pen further comprising removable means for sealing the cap hole.

In preferred embodiments, control of the continuous flow comprises adjustment of the extension of the needle within the feeder.

For example, the barrel and the cap further comprise matching screw and thread, whereby the extension of the needle is controlled by rotating the cap relative to the barrel.

The cap may be configured to allow feeding the ink into said barrel and prevent escape of the ink out of the proximal opening of the barrel.

The feeder and/or nib may be configured to prevent escape of the ink out of the distal opening of the barrel.

Preferably, the distal part of the feeder is slanted such as to conform the feeder to the distal opening of the nib.

In preferred embodiments, the distal feeder opening is positioned closer to the tip than breather hole Some preferred embodiments are configured to allow steady flow of the ink to the writing tip.

Some embodiments are further configured to prevent blotting of the ink on the media.

Some embodiments are used with ink which is Jewish scripture ink and the media is a Jewish scroll.

DETAILED DESCRIPTION

The invention relates to improved writing utensils and accessories to aid in writing, such as but not limited to writing on scrolls, as will be described hereafter.

Objects of the invention are to provide simple writing utensils that require minimal maintenance and/or improve and/or speed up writing.

These together with additional objects, features and advantages of the writing utensils will be readily apparent to those of ordinary skill in the art upon reading the following detailed description, and viewing the illustrative, embodiments of the writing utensils when taken in conjunction with the accompanying drawings.

In this respect, before explaining the current embodiments of the writing utensils in detail, it is to be understood that the utensils are not limited in their applications to the details of construction and arrangements of the components set forth in the following description or illustration. Those skilled in the art will appreciate that the concept of this disclosure may be readily utilized as a basis for the design of other structures, methods, and systems for carrying out the several purposes of the utensils. It is therefore important that the claims be regarded as including such equivalent construction insofar as they do not depart from the spirit and scope of the utensils. It is also to be understood that the phraseology and terminology employed herein are for purposes of description and should not be regarded as limiting.

The invention relates to utensils that may help improve writing quality and/or style, as well as speeding the writing and/or rendering it more consistent and/or minimally interrupted.

We have found that pen nibs having writing tips made of a material including ceramic material may have several unexpected advantages over nibs made of steel and some other hard materials, for example smoother and more consistent writing, while also requiring less maintenance.

We have also designed writing utensils that are both simple and effective in controlling the flow of ink, for example to nibs with ceramic tips.

Reference is now made to the figures representing various embodiments.

According to one aspect, a nib with a ceramic tip is provided.

Figure 1B:
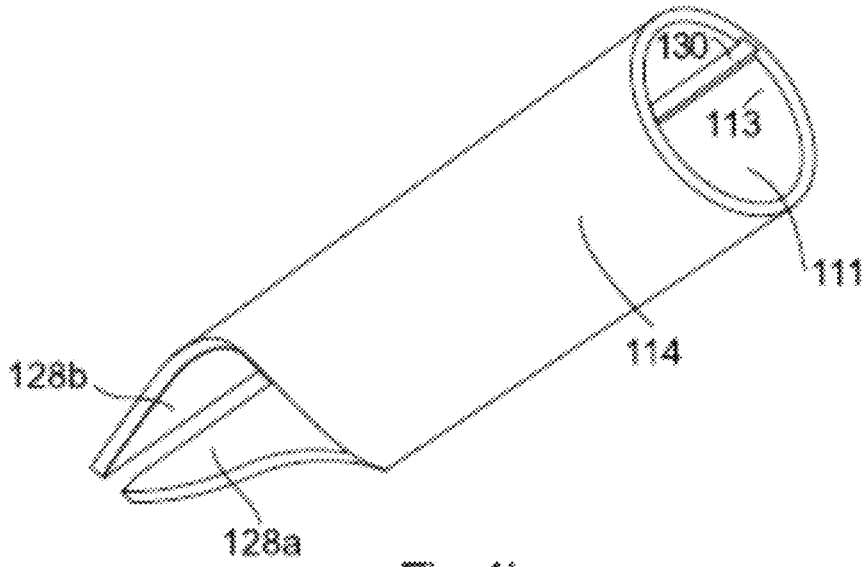
FIG. 1*b* shows the embodiment in back view of the tube which is part of the nib.

FIGS. 1*a* and 1*b* illustrate front and back perspective views, respectively, of an improved nib 100 for writing with ink on media.

The nib includes a tube 110 having a proximal opening 111 and a slanted distal opening 112. As shown in FIG. 1*b*, a back view of the tube 100, the tube 100 also has an interior wall 113 and an exterior wall 114. The nib 100 has an exposed writing tip 120 at a distal end 122 of the nib 100. The tip 120 is made of a material that includes a ceramic material.

The nib 100 also has a groove 130 extending from the tip 120 along at least a portion of the interior wall 113.

The groove 130 divides the tip 120 into tines 128*a*, 128*b*.

In some embodiments, the whole nib 100 is made of ceramic material, in other embodiments only part of the nib 100 is made of ceramic material; in particular the tip 120 is ceramic.

The ceramic material has several qualities that are desirable in nibs, for example, the ability to be polished to a high degree, thus providing a very smooth and easy writing, and high rigidity, a quality which most contemporary writers seem to prefer to have in their nibs, perhaps because these nibs stand up very well to being used with a firm writing pressure, used by most modern writers, who have typically learned to write so when using a ballpoint.

Some writers do prefer the better stroke variation resulting from use of more flexible nibs, in which pressing firmly causes the nib's tines to spread, and the stroke thus grows broader. Flexible nibs have been made in semi-flexible, flexible, and super-flexible variants. Embodiments which are flexible may be made of composite or multiple materials, for example the tip may be made from a ceramic material and the tines from a more flexible material.

However, manufacture of nibs made entirely of a ceramic material may be simpler than manufacture of nibs made of multiple materials.

Some embodiments may be manufactured from a variety of ceramic materials. For example, the ceramic materials used to manufacture the nibs may include ceramic whiskers, typically having cross-sectional diameters of 0.1-10 micrometers and lengths of 10-1000 μm, which may reinforce the hardness, strength and stiffness of the nibs and reduce their brittleness. Some other embodiments are manufactured from fiber-reinforced composites, whose incorporation into the nibs imparts similar advantageous properties.

The groove 130 on the nib allows capillary movement of the ink along the interior wall 113, led towards the tip 120. In preferred embodiments the groove 130 includes at least one slit 132 extending from the tip along part of the interior wall 113, such that the nib 100 usually has one slit 132 cut down its center, to help convey ink down the nib 100 by capillary action. Such slit may be made during injection molding of the nib 100, or a slitless nib (not shown) produced by injection molding may be cut with a disk to make the slit 132. Additionally, in some preferred embodiments a "breather hole" 140 of varying shape is formed at the proximal end 134 of the slit 132, for example during the injection molding of the nib 100, to promote the exchange of air for ink in the pen's reservoir as well as to act as a stress relieving point, helping to prevent the nib 100 from cracking longitudinally from the proximal 134 end of the slit from repeated stress during use.

The nib 100 is preferably and conveniently manufactured by injection molding, and preferably the nib 100 is manufactured with a groove 130 extends all along the interior wall, as is shown in particular in FIG. 1*b*. Alternatively, the nib 100 may be made by powder metallurgy, cold press and other methods of ceramic preparations known in the art.

Suitable ceramic materials are known in the art, for example the ceramic materials may be one or more alumina, zirconia, carbides and nitrides.

The nib 100 may be used for example for writing Jewish scriptures. Such scriptures are written using very special ink, which is very viscous, and the viscosity also strongly depends on temperature, making control of the flow of the ink difficult. Accordingly, some of the nib embodiments with ceramic tips may help to improve the uniformity of flow of inks, due to for example the reduced effect of pressure on the width of the groove 130, and the relatively high amount of heat required to raise temperature of unit mass of material by one unit. In some embodiments, the nib 100 may be configured to allow uniform flow by careful design of the geometry, such as the width and/or depth of the groove 130.

A particular problem of writing Jewish scriptures is blotting of the parchment due to overloading the pen, overheating the ink or other causes, which may disqualify a painstakingly written portion. Indeed, perhaps the most common problem of fountain pens is ink blotting (pen periodically lets out huge drops or blots of ink during writing) or ink flooding (point consistently lays down too much ink). Ink blotting is caused by the difference of temperature and/or air pressure between inside and outside of a fountain pen. Therefore, it often happens in the winter times, when the cold air in the reservoir or ink cartridge is warmed by the hand and expanded too quickly, which pushes out too much ink, or on the airplane, when the air pressure gets low. Therefore, in some embodiments, the nib 100 is further configured to prevent blotting of the ink on the media. For example, the nib 100 may include comb cuts (not shown, see—see http://www.nakaya.org/ekozo.html) for that purpose.

Moreover, Jewish scriptures as well as some other scriptures are typically written with quills of other dip-pens, which require frequent refilling, removal of excess ink, drainage of ink, leaks etc., which interrupt or disturb the flow of ink. Therefore, as well as the nib itself, other parts of the pen should preferably be configured to allow uniform flow of ink during writing.

Figure 1C:
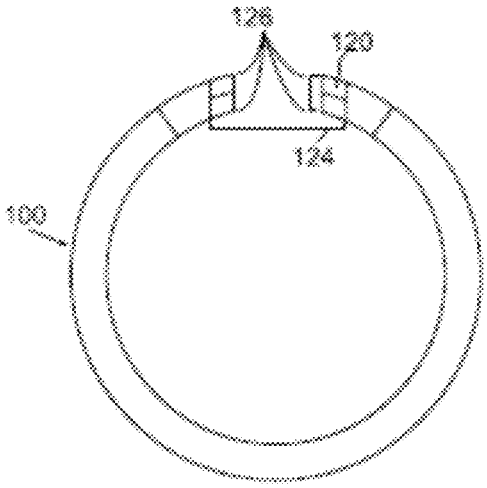
FIG. 1*c* shows a frontal view of a writing tip embodiment.

Jewish scriptures may be of various sizes, mezuzah typically being small and Torah scrolls typically being large. Accordingly, some embodiments are particularly suited for the size of the characters, for example the tip width 124 (see FIG. 1*c*) is configured (such as by polishing the tip to reduce the width 124) to suit the size of the Jewish scripture to be written, as the larger the width 124 the broader the vertical written lines.

In some preferred embodiments, as in the embodiment shown in FIGS. 1*a* and 1*b*, the tip 120 is sharp. The sharpness allows writing delicate and thin horizontal or oblique lines for example. Such embodiments may be particularly suitable for writing Jewish scriptures. In some other embodiments, the tip 120 is chiseled, as chisel is a common profile in some calligraphic pens.

The nib embodiments are suitable for use for example in fountain pens, calligraphic pens and quills.

The tips may be round, stub, italic, calligraphic, and/or oblique (not shown). The exact shape affects the shape and thickness of the written characters, which also depend on how the pen is held, such as what the orientation of the nib is relative to the media, in which hand the pen is held etc.

In some preferred embodiments, the groove 130 is tapered toward the tip 120 (not shown). The tapered slit may help provide stable capillary action, and nibs with tapered slits are usually more reliable writers than those with straight slits.

Various methods of ceramic preparation may be used to prepare the nibs. For example, according to a preferred embodiment, the preparation involves injection molding of the tip. In further preferred embodiments, the preparation is injection molding of entire nibs.

Although the ceramic tips may last for a very long time, essentially maintaining a steady good writing quality during all that time, nevertheless the user may desire to polish the tip, change its profile and/or dimensions etc, typically before first use, to conform with the user's preferred style of writing, for example.

According to one embodiment, the polishing and profile changing may be performed by grinding down the nib tip 120, which includes frictionally moving the nib tip relative to a metal bond diamond polishing means. A file or a set of files (medium, fine and superfine coarseness are typically suitable) may serve for the polishing. Typically a skilled in the art (nibmeister) may thus obtain a desired profile within a fairly short period of time, such as 5 minutes.

Some embodiments are produced with the desired profile during injection molding. However, even tips of nibs produced so with the desired profile are preferably polished afterwards.

The polishing may help to bring the tip width 124 and/or sharpness to a desired size. For writing in most Jewish scriptures the preferred width 124 is about 2.5-3 mm. The polishing also may further improve the smoothness of the writing, for example by rounding off the corners 126 of the tip 120.

In some embodiments, the tip 120 is machined, to produce a sharp profile as shown in FIGS. 1*a* and 1*b*. In some embodiments, the side facing the exterior wall 114 is machined, and the side facing the interior wall 113 is polished. In some other embodiments, both sides are polished.

As shortly discussed above, other parts of the pen could also be configured to allow uniform flow of ink during writing.

Figure 2A:
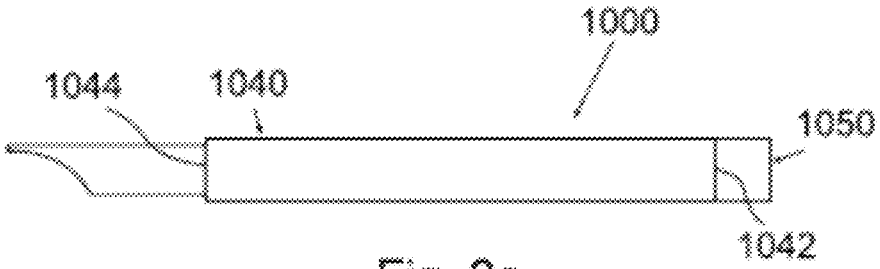
FIG. 2*a* shows a side view of an improved pen.
Figure 2B:
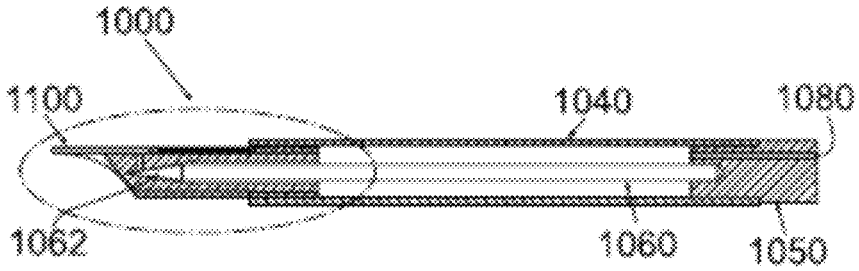
FIG. 2*b* shows a side cross-section of an improved pen embodiment with an improved nib.

According to another aspect, an improved pen for writing with ink on media is provided. Referring to FIGS. 2*a* and 2*b*, showing side views (FIG. 2*b* is a cross section) of a pen embodiment 1000, and exploded views FIGS. 3, 4, the pen 1000 includes:

- a hollow barrel 1040 having proximal 1042 and distal 1044 openings;
- a cap 1050 on the proximal opening 1042 of the barrel 1040;
- a needle 1060 attached to the cap 1050 and distally extending from the cap 1050 throughout the barrel 1040, the needle 1060 comprising a distal part 1062 having a tapering shape;
- a nib 1100 comprising: a tube 1110 comprising a proximal opening 1111, a slanted distal opening 1112, an interior wall 1113 and an exterior wall 1114; an exposed writing tip 1120 at a distal end 1122 of the nib 1100, a groove 1130 extending proximally from the tip 1120 along at least a portion of the interior wall 1113, and
- a nib ink feeder 1070, comprising: a proximal part 1072 having a proximal feeder opening 1073; a distal part 1074 having a distal feeder opening 1075; an exterior wall 1076 and a first 1077 and a second feeder hole 1078.

The distal part 1074 of the feeder 1070 is positioned within the nib 1100 and the proximal part 1072 of the feeder 1070 seals the distal opening 1044 of the barrel 1040; the wall 1076 at the distal part 1074 of the feeder 1070 is flush with the interior wall 1113 of the nib 1100; the first hole 1077 extends from the proximal feeder opening 1073 through part of the feeder 1070 to a tapered part 1079, the tapered part 1079 being similar in profile to the distal end 1062 of the needle 1060. The second hole 1078 extends from the tapered part 1079 of the first hole 1077 to distal feeder opening 1075 and is fluidly communicable the groove 1130 of the nib 1100 (the feeder opening 1075 is aligned with the groove 1130 so that ink may pass through the second hole 1078 directly into the groove 1130).

The needle 1060 is reversibly extendible within the feeder 1070,

And the pen 1000 is configured to allow continuous flow of the ink during writing with the pen and control of the flow rate of the ink.

In some embodiments (not shown) the nib 1100 does not reach the barrel 1040 and the feeder 1071 connects between them. In such embodiments the feeder may have a groove that is open to the atmosphere, and there may be a second hole in the feeder (as described above) leading to the external feeder groove to allow ink to travel from within the feeder to that groove rather than to a groove in the nib. The feeder groove may extend all the way to the nib slit and the nib thereby may not require a groove behind the slit. Moreover, the feeder may not be hollow, but rather simply have a groove extending from the slit all the way to the part of the feeder plugged into the barrel, such feeders are used in some commercially available fountain pens. In such pens there may be no possibility of adjusting the ink flow with the needle and other means may be used for the adjustment of the flow, for example adjustment of the flow properties of the ink (e.g. adding to the ink a miscible and viscous reagent at a suitable concentration).

There may be a breather hole along or at the proximal end of the feeder groove, and/or a breather hole along or at the proximal end of the nib.

In some embodiments, the cap 1050 has at least one filling hole 1080 extending through the cap 1050, and control of the continuous flow includes adjustment of the extension of the needle 1060 within the feeder.

The cap 1050 may as described above, or otherwise, be configured to allow feeding the ink into said barrel 1040. The feeding may be via access holes 1080, or another hole. The ink feeding hole 1080 may be configured to prevent escape of the ink out of the proximal opening 1042 of the barrel 1040, for example by placing a needle, pin, ball valve or septum in the hole (not shown), and optionally to maintain a subpressure in the barrel 1042 during writing, which may help the ink to flow along the nib 1100. The cap 1050 may be made of polyethylene, polypropylene, ABS or other polymers, the pin may be made of metal, for example.

Figure 3:
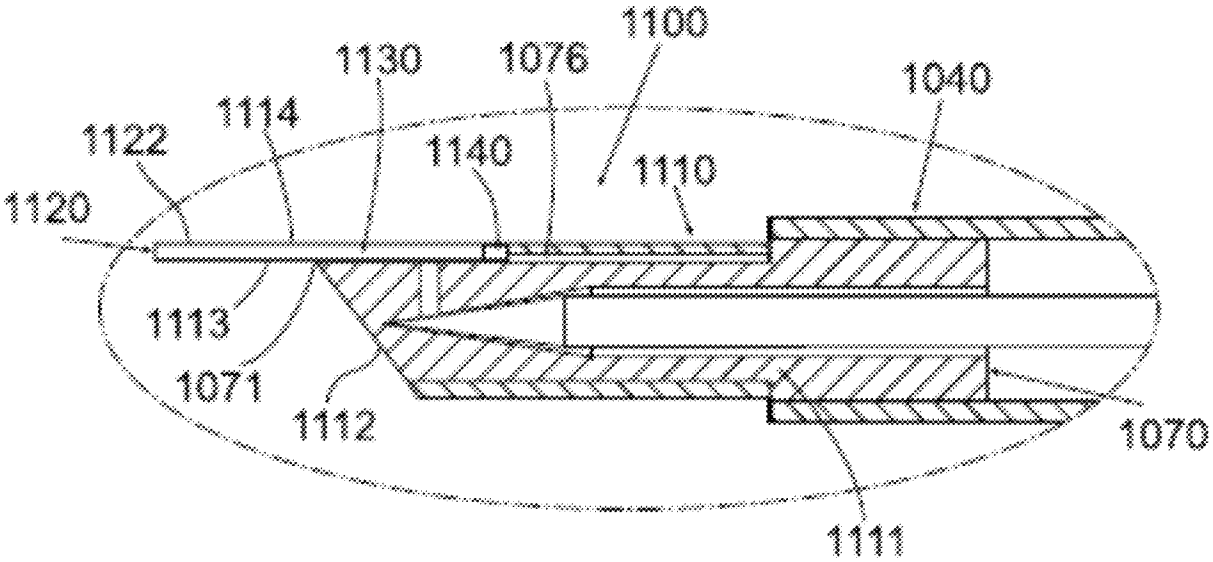
FIG. 3 illustrates an exploded view of the proximal area of the improved pen, set to stop flow of ink from the pen.
Figure 4:
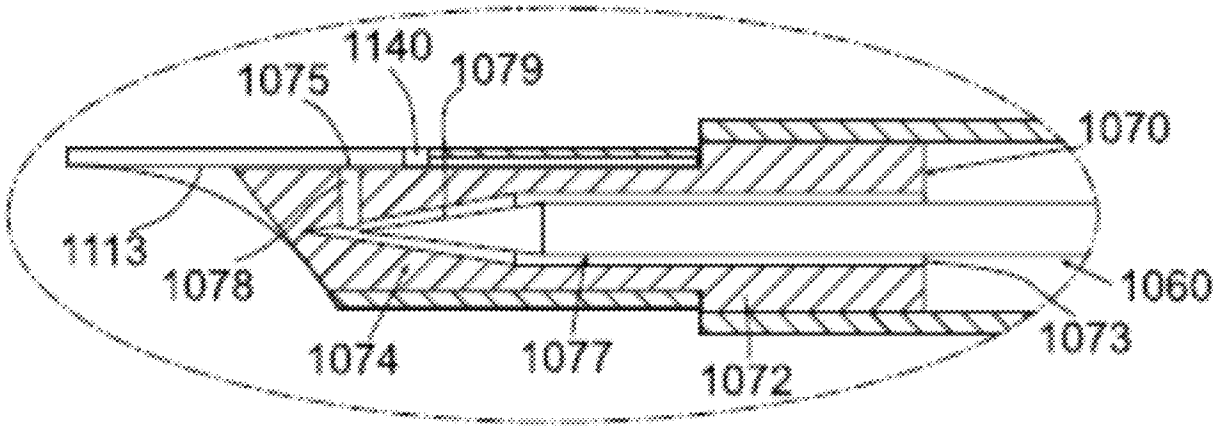
FIG. 4 illustrates a similar exploded view, but with the pen set to allow flow of ink from the pen.

When the needle 1060 is in an open position, as shown in FIG. 4, and ink is being drawn out of the nib 1100 by writing with the pen 1000. However, depending upon the type of ink used, the writing speed, and the (preferably minimal) gap between the wall 1076 at the distal part 1074 of the feeder 1070 from the interior wall 1113 of the nib 1100 etc., ink might sometimes excessively accumulate at the distal extremity 1071 of the feeder 1070 (FIGS. 3, 4) if the flow of the ink out of the feeder 1070 is much faster than the flow along the groove 1030, or the flow along the groove may be too fast. In such circumstances the needle is adjusted so that the tapered part 1079 in the first hole 1077 is narrower, thus slowing the flow out of the feeder 1070. Typically, whatever the position of the needle 1060, the bottleneck for the flow of ink out of the tip 1120 is the capillary flow of ink along the groove 1130. When the needle 1060 is in the closed position, as shown in FIG. 3, there is no flow of ink out of the pen 1060.

The needle 1060 may be reversibly extendible for example by performing a screwing action, such as when the bottom of the cap 1050 and the top interior wall of the barrel 1040 next to the proximal opening 1042 have matching screw and thread, and the cap may thus be screwed into the barrel and accordingly extending the needle 1060 within the feeder 1070 (not shown).

The feeder 1070 and/or the nib 1100 and/or other parts in the pen 1000 are configured to prevent leaks of the ink, for example out of the distal opening 1044 of the barrel 1040. For example, feeder 1070 has a thread on the exterior wall 1076 at the proximal part 1072 that can be tightly screwed onto a matching internal thread extending from the distal opening 1044 of the barrel 1040 into the barrel 1040), and the nib 1100 abuts the distal part 1074 of the feeder 1070. A heat-shrink sleeve may be formed over the nib 1100 and the feeder 1070 and optionally also the barrel 1040, to help keep the nib 1100 in place. The heat-shrink sleeve may thus keep the groove 1130 of the nib 1100 aligned with the second hole 1078.

Obviously, the pen 1000 may easily be manufactured according to other arrangements, in which the nib 1100 is closely matching the interior wall of the barrel 1040 or over the exterior wall of the barrel (not shown), optionally fastened with a screw and thread arrangement, gluing etc. to attach the nib-barrel parts and to help prevent leak of ink out of the distal opening 1044 and to stabilize the position of the nib 1100.

Preferably, as shown in FIG. 3, the part of the feeder 1070 next to the distal extremity 1071 is slanted such as to conform the feeder 1070 to the proximal opening 1112 of the nib 1100. This conformity may allow freely writing without hindrance by the feeder 1070 as well as providing an aesthetically pleasing pen 1000.

Whereas most utensils for writing such scriptures require frequent refilling, embodiments such as the described improved pen 1000 allow continuous writing on a scripture. Moreover, the special ink is both very viscous and the viscosity is very temperature-dependent, such as from change of temperature of the pen 1000 from hand-contact. Pen 1000 allows precise adjustment of the flow to allow for a steady flow of ink to the scripture, while avoiding blotching the parchment. Some embodiments may have ceramic nibs. The pens and ceramic nibs may be configured to match each other, to optimize control of the ink flow for example.

In particular, preferably, the nib 1100 has a breather hole 1140. In general, the hole 1140 facilitates flow of the ink. In ceramic nibs, the hole 1140 also helps dissipate stress on the nib 1100 and prevent cracking of the nib 1100.

Most preferably, distal feeder opening 1075 is positioned closer to the tip 1120 than breather hole 1140.

It is notable that the tip 1120 is flat. The tip 1120 may be polished, for example sharpened, or merely the edges (see FIG. 1*c*) of the tip may be smoothed, such that the pen is suitable for some calligraphic applications.

Figure 5:
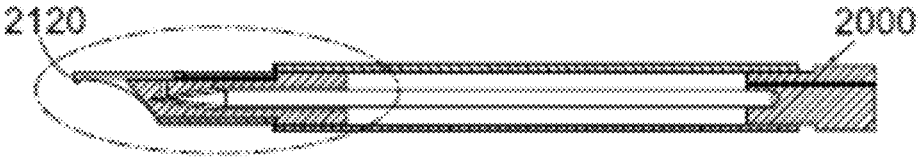
FIG. 5 is a side view of an improved fountain pen.

FIG. 5 shows a pen 2000 with a tip 2120 particularly useful as fountain pen.

It should be clear that the description of the embodiments and attached Figures set forth in this specification serves only for a better understanding of the invention, without limiting its scope as covered by the following Claims.

It should also be clear that a person skilled in the art, after reading the present specification can make adjustments or amendments to the attached Figures and above described embodiments that would still be covered by the following Claims.

The invention claimed is:

1. An improved nib for writing with ink on media, the nib comprising:

a tube comprising a proximal opening, a slanted distal opening, an interior wall and an exterior wall;

an exposed writing tip at a distal end of the nib, wherein the tip comprises a width, and a groove extending from the tip along at least a portion of the interior wall, and a slit extending from the tip along a part of the nib, wherein the tip is made of a material comprising ceramic material, and wherein the groove is tapered toward the tip.

2. The nib of claim 1, wherein the nib is made of ceramic material.

3. The nib as in claim 1, wherein the ceramic material is selected from one or more of the group comprising: alumina, zirconia, carbide, mullite, corierite, nitride and combinations thereof.

4. The nib of claim 1, wherein the ceramic material comprises ceramic fibers and/or ceramic whiskers.

5. The nib of claim 1, wherein the nib further comprises at least one breather hole at a proximal end of the slit.

6. The nib of claim 1, configured to allow steady flow of the ink to the writing tip.

7. The nib as in claim 1, further configured to prevent blotting of the ink on the media.

8. The nib of claim 7, wherein the nib width is configured to suit the size of a Jewish scroll.

9. The nib of claim 1, wherein the tip is chiseled.

10. The nib of claim 9, wherein the width is between about 0.5 and 3 mm.

11. An improved pen for writing with ink on media, the pen comprising:

a hollow barrel having proximal and distal openings;

a cap on the proximal opening of the barrel;

a needle attached to the cap and distally extending from the cap throughout the barrel, the needle comprising a distal part having a tapering shape;

a nib comprising: a tube comprising a proximal opening, a slanted distal opening, an interior wall and an exterior wall; an exposed writing tip at a distal end of the distal opening, a slit extending from the tip along a part of the nib, and a groove extending proximally from the tip along at least a portion of the interior wall, and;

a nib ink feeder comprising: a proximal part having a proximal feeder opening; a distal part having a distal feeder opening; an exterior wall and a first and a second hole; the distal part of the feeder being positioned within the nib and the proximal part of the feeder sealing the distal opening of the barrel; the wall of the feeder at the distal part of the feeder being flush with the interior wall of the nib; the first hole extending from the proximal feeder opening through part of the feeder to a tapered part, the tapered part being similar in profile to the distal end of the needle, the second hole extending from the tapered part of the first hole distal feeder opening and fluidly communicable with the groove, the needle being reversibly extendible within the feeder, the pen configured to allow continuous flow of the ink during writing with the pen and control of the flow rate of the ink.

12. The improved pen of claim 11, wherein the cap further comprises at least one cap ink-filling hole extending through the cap, the pen further comprising removable means for sealing the cap hole.

13. The improved pen of claim 11, wherein control of the continuous flow comprises adjustment of the extension of the needle within the feeder.

14. The improved pen as in claim 11, wherein the distal part of the feeder is slanted such as to conform the feeder to the distal opening of the nib.

15. The improved pen as in 11, wherein the nib is the nib as in claim 1.

16. The improved pen as in claim 11, further configured to prevent blotting of the ink on the media.

17. The nib of claim 11, wherein the ink is Jewish scripture ink and the media is a Jewish scroll.

* * * * *